US008950314B2

(12) United States Patent
Moberg

(10) Patent No.: US 8,950,314 B2
(45) Date of Patent: Feb. 10, 2015

(54) YOKE POSITION SENSOR FOR A HYDRAULIC DEVICE

(75) Inventor: Leif Moberg, Vänersborg (SE)

(73) Assignee: Parker Hannifin AB, Trollhattan (SE)

( * ) Notice: Subject to any disclaimer, the term of this patent is extended or adjusted under 35 U.S.C. 154(b) by 1283 days.

(21) Appl. No.: 12/562,076

(22) Filed: Sep. 17, 2009

(65) Prior Publication Data

US 2010/0150745 A1 Jun. 17, 2010

(30) Foreign Application Priority Data

Sep. 17, 2008 (SE) ..... 0801982

(51) Int. Cl.
*F01B 25/26* (2006.01)
*F04B 1/32* (2006.01)

(52) U.S. Cl.
CPC ..... *F04B 1/324* (2013.01); *F04B 2201/12051* (2013.01)
USPC ..... 92/5 R

(58) Field of Classification Search
USPC ..... 91/1, 499, 504, 505; 92/5 R, 12.2, 12.1, 92/71, 13; 417/221.1
See application file for complete search history.

(56) References Cited

U.S. PATENT DOCUMENTS 3,733,970 A * 5/1973 Bosch ..... 91/506
4,489,552 A 12/1984 Watanabe et al.
4,496,289 A * 1/1985 Heiser et al. ..... 417/217
4,655,689 A * 4/1987 Westveer et al. ..... 417/53
4,822,252 A * 4/1989 Ishikawa et al. ..... 417/222.2
4,823,552 A * 4/1989 Ezell et al. ..... 60/443
4,991,492 A 2/1991 Bratt et al.
5,022,826 A * 6/1991 Matsuda et al. ..... 417/63
5,073,091 A * 12/1991 Burgess et al. ..... 417/222.1
5,085,128 A * 2/1992 Nakamura et al. ..... 91/504
5,135,031 A 8/1992 Burgess et al.
5,407,328 A 4/1995 Kimura et al.
5,881,629 A 3/1999 Gollner et al.
6,244,159 B1 * 6/2001 Kimura et al. ..... 92/12.2
6,301,885 B1 * 10/2001 Johnson et al. ..... 60/487
6,378,300 B1 * 4/2002 Johnson et al. ..... 60/399
6,547,531 B1 * 4/2003 Cumbo et al. ..... 417/63
6,623,247 B2 * 9/2003 Du ..... 417/53
6,848,888 B2 2/2005 Du (Continued)

FOREIGN PATENT DOCUMENTS

JP 59/082593 12/1984
JP 3020172 A 1/1991

(Continued)

*Primary Examiner* — Edward Look
*Assistant Examiner* — Michael Quandt
(74) *Attorney, Agent, or Firm* — Renner, Otto, Boisselle & Sklar, LLP

(57) ABSTRACT

An embodiment the invention relates to a yoke position sensor system (7) for a hydraulic device (1), such as a pump or motor, provided with a moveable yoke (3) which is used for varying the displacement of the hydraulic device (1) and to a method for sensing the position of a yoke (3) relative to a housing (2). The housing (2) and the yoke (3) are movably and rotatably connected to each other. When the yoke (3) is rotated, there is a yoke angle sensor (5) indicating the degrees of rotation of the yoke and a yoke angle of zero corresponds to a zero displacement volume. The hydraulic device (1) includes a second yoke angle sensor (7) constructed to indicate when the yoke angle is within or outside an interval including the zero displacement angle.

11 Claims, 7 Drawing Sheets

(56) References Cited

U.S. PATENT DOCUMENTS

| | | | | |
|---|---|---|---|---|
| 7,032,377 | B1 * | 4/2006 | Keller et al. | 60/399 |
| 7,275,474 | B2 * | 10/2007 | Larkin et al. | 92/5 R |
| 7,275,475 | B2 | 10/2007 | Deschamps et al. | |
| 7,380,490 | B2 * | 6/2008 | Kadlicko | 91/505 |
| 7,784,277 | B2 * | 8/2010 | Anderson et al. | 60/418 |
| 2004/0103659 | A1 * | 6/2004 | Johnson et al. | 60/500 |

FOREIGN PATENT DOCUMENTS

| | | |
|---|---|---|
| JP | 4022776 A | 1/1992 |
| JP | 2000/130557 | 12/2000 |

* cited by examiner

YOKE POSITION SENSOR FOR A HYDRAULIC DEVICE

CROSS-REFERENCE TO RELATED APPLICATIONS

This application is a U.S. Nonprovisional Application which claims priority benefits of SE0801982-0 filed Sep. 17, 2008 which is hereby incorporated by reference in its entirety.

TECHNICAL FIELD

The invention relates to a yoke position sensor for a hydraulic device such as a pump or motor provided with a moveable yoke which is used for varying the displacement of the hydraulic device. Hence, the sensing of the position of the yoke is an indication of the displacement of the hydraulic device. The invention further relates to a method for sensing the position of a yoke.

BACKGROUND ART

Hydraulic pumps and motors may generally be divided in two main categories, fixed displacement devices and variable displacement devices. The advantage with a variable displacement device is quite obvious in that it is possible to vary the volume capacity of the device in a rather easy way. However, since there is a possibility to vary the displacement volume there is also a desire to indicate and control the displacement volume.

In U.S. Pat. No. 6,848,888 is disclosed a magnetic sensor used to indicate the position, or angle, of a swash plate relatively its housing in order to decide the displacement volume. U.S. Pat. No. 7,275,474 describes a system using markings on a swash plate, yoke or the like movable part of the hydraulic device which may be read optically or electronically by a sensor fixedly located on the housing in order to decide the absolute position of the movable part. U.S. Pat. No. 4,822,252 describes the use of a magnetic arrangement in order to detect the degree of inclination of a wobble plate of a variable capacity compressor. Still further arrangement for detection of a swash plate angle or yoke position is disclosed in for example U.S. Pat. No. 5,881,629; U.S. Pat. No. 5,135,031 or U.S. Pat. No. 5,073,091.

Even though the above cited documents provide different solutions for detecting the displacement of a variable displacement hydraulic devices there is still a desire to improve such a detecting system and provide a more robust and safe system for sensing the position of the moveable part, e.g. a yoke, in order to better control the hydraulic system

DISCLOSURE OF THE INVENTION

Exemplary embodiment of the present invention provides a robust and safe system for sensing and indicating the position of a yoke in a hydraulic device such as a pump or motor. In particular, an embodiment of the present invention is directed to the indication of a non-working position of the yoke or swash plate where there is no (or very small) displacement. In many cases it is important to determine, e.g. for safety reasons, if the hydraulic pump or motor is in a non-working or working position.

Hence, the present invention relates to a Minimum Displacement Sensor (MDS) which is positioned on the hydraulic motor or pump to provide supplementary yoke information to the control system for monitoring of an analogue Yoke Angle Sensor (YAS) accuracy. The basic purpose is to avoid undesired or even hazardous modes of operation at insufficient correlation between measured and actual yoke angles, especially at measured yoke angles close to zero, i.e. small displacement. A purpose of this MDS is thus to indicate when the yoke angle is within a certain limit such that the displacement is small enough so that the flow volume produced is below a desired or indicated safety limit. This limit may for example be used when determining an allowed maximum flow at start up of the hydraulic device.

In some exemplary embodiments, the sensor is an inductive digital sensor. The sensor may be located in the housing or in the cover at a fixed position and the indicating steel bar moving with the yoke. The inductive type sensor will sense the proximity of the steel bar and use the interaction between an electromagnetic alternating field at the sensing face of the sensor and a metallic conductor, i.e. the target which in this case is the steel bar. When the steel bar is present in front of and proximate to the sensor, eddy currents are induced in the metallic damping material of the target. As a result, energy is removed from the electromagnetic field and reduces the oscillation amplitude of the electromagnetic field such that the presence of the target (steel bar) is sensed and the sensor signal thus indicates that the yoke is positioned within the near zero displacement or non-working position. The change or state of the electromagnetic field is processed in the inductive sensor which changes its output state accordingly.

In general, these kinds of sensors may be used for detecting axial movement of a target relatively a sensor. By axial movement is meant either approaching or withdrawal of the sensor and the target in a direction perpendicular to the sensor and target surfaces. In this case, the sensor switches on when the gap between the target becomes less than a first, certain distance and remains turned on until the gap becomes larger than a second, certain distance. Due to hysteresis, the first and second value will differ such that the distance between the sensor and the target when the sensor changes from on to off is larger than the second distance, when the sensor changes from off to on. Hence, the distance to the target from the sensor must be within a minimum distance in order to make it possible for the sensor to sense the target.

However, these sensors may be used to sense longitudinal movement or, like in this case, radial movement. According to one embodiment of the invention, a yoke is provided with a target bar or an indication bar, e.g. a steel bar. In this case the extension of the indication bar in the radial or longitudinal direction (i.e. in the direction of movement of the yoke) in a part of the yoke passing and facing the yoke angle sensor when the angle of the yoke is changed will be the main option for setting or changing the desired yoke angle interval to be indicated. There are also other parameters influencing the sensitivity of the sensor system and, in addition to the radial length of the indicator bar, such features as the selection of material for the target bar, in particular the magnetic properties, will influence the sensitivity of the system. Hence, there are many ways to influence the area or distance or interval wherein the sensor will indicate presence of the indication bar. Also the width of the gap between the sensor and the indication bar is an important feature concerning the sensitivity of the sensor system. In general, using a normal gap width from 0.3 to 1.2 millimeter (mm) and a common material for the indication bar, i.e. a steel bar, the minimum length of the bar in the radial direction, i.e. the length of the bar passing by the sensor, required has been determined to be at least 5 mm in order to assure that the sensor really indicates presence of the bar. A shorter bar will not surely be sensed unless the gap between the yoke and the cover (or actually, the sensor and the indication bar) will be too small to be practically convenient. According to a specific sensor arrangement, comprising a BES 516-300-S 205-D-PU-03 sensor from Balluff and a HU-7541 indicator bar, the rated operating distance for axial approach or withdrawal is in the range from 0 up to 1.5 mm. In practice, to be used for radial detection, the distance or gap between the sensor and the indication bar must be smaller than that in order to avoid uncertain operation due to non-sensing of the indication bar when passing by in front of the sensor. Depending on the specific desired characteristics, a suitable sensor and indication bar, from for example Balluff, may be chosen and configured and adapted to perform and indicate presence/non-presence of the target bar within the sensing range of the sensor.

BRIEF DESCRIPTION OF THE DRAWING(S)

EMBODIMENT(S) OF THE INVENTION

Figure 1:
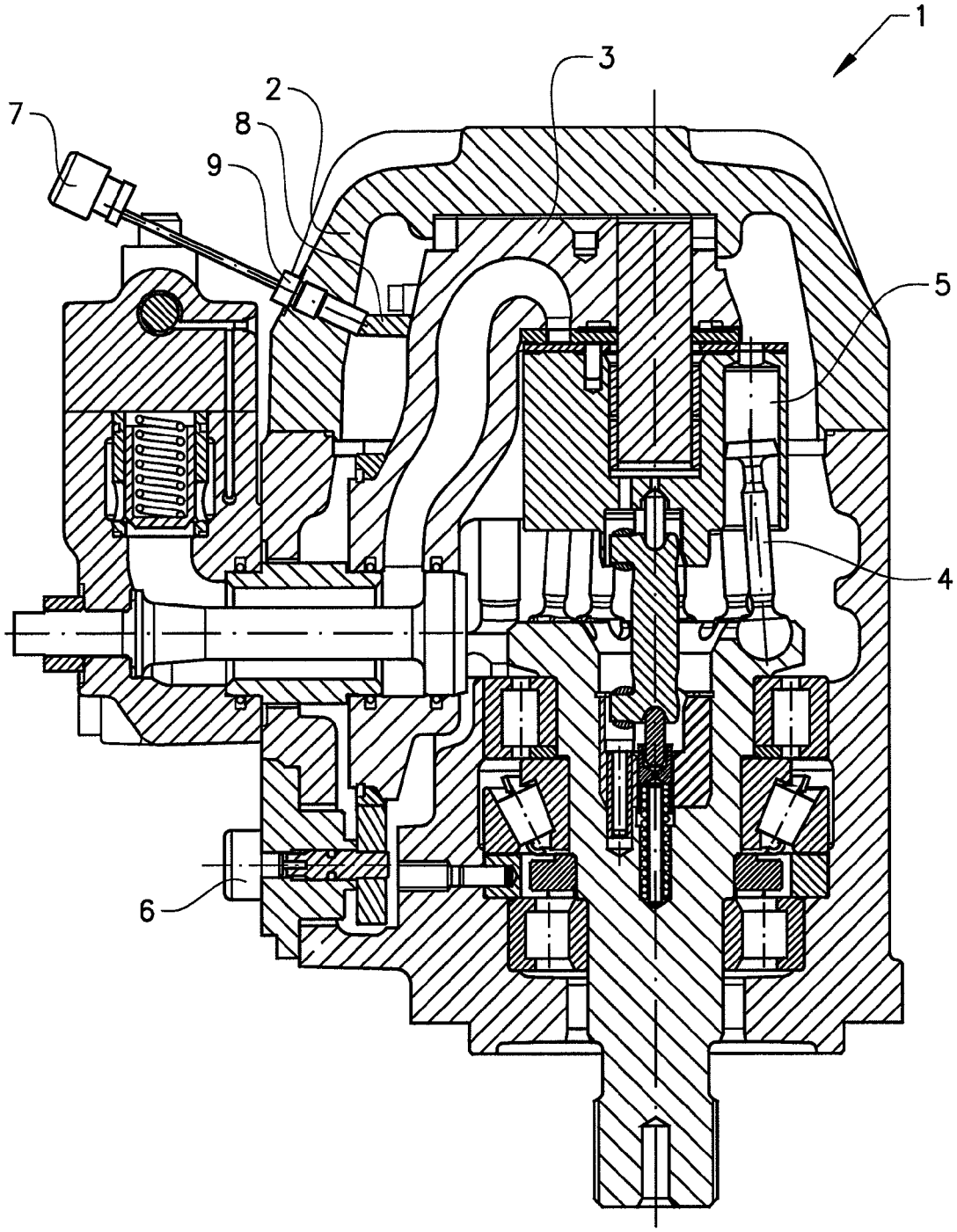
FIG. 1 is a variable displacement hydraulic pump an embodiment comprising a Minimum Displacement Sensor (MDS) according to an embodiment of the invention.

FIG. 1 shows a hydraulic pump 1 comprising a housing 2 and a yoke 3 which is movably connected to the housing 2 and rotates around an axis such that the rotation of the yoke 3 around the axis corresponds to a yoke angle. When the yoke 3 is moved relative to the housing 2 the length of stroke of the pistons 4 in the cylinders 5 is changed such that the displacement volume of the pump 1 is changed. Hence, the displacement volume is related to the yoke angle such that the displacement volume of the pump 1 may be determined if the yoke angle position is known. The details of the pump 1 are not described herein but a suitable hydraulic pump for the present invention is for example described in detail in U.S. Pat. No. 4,991,492. The pump comprises a first yoke angle sensor (YAS) 6 adapted to sense and indicate the yoke angle over a wide range, essentially the complete operating range of the hydraulic pump, so as to provide a control system with a yoke angle indication corresponding to a displacement volume. A number of suitable sensors to be used as this first yoke angle sensor 6 is for example described in U.S. Pat. No. 6,848,888, U.S. Pat. No. 7,275,474, U.S. Pat. No. 5,881,629 or U.S. Pat. No. 5,135,031. In particular when the first yoke angle sensor 6 is a relative sensor, i.e. the zero displacement volume or zero displacement angle is based on a calibrated value, the measured and actual values may differ if there is something wrong with the calibration. An uncertainty in the actual value of the yoke angle may be particularly dangerous if the actual value corresponds to a larger value than the indicated value. In particular if the sensed value is within the low displacement volume interval and certain operations are performed which only are allowed when there is a small displacement volume, there may be violation of the safety rules. Even if the first yoke angle sensor 6 is an absolute sensor, the sensor may not be accurate enough or the sensor may break down or in some other way not be useful for showing the right yoke angle value. Hence, it may be desired to include a redundancy in the system even if the first sensor is an absolute position sensor and thus using a second yoke angle sensor system 7, a so-called Minimum Displacement Sensor (MDS). The main purpose of the MDS 7 is to detect when the yoke is in a "safe" interval, i.e. when the yoke is positioned such that there is no risk of an acceleration torque to be generated. Hence, the exact position or interval where the MDS 7 shall indicate may be decided differently for each hydraulic pump or motor. The MDS 7 comprises a target bar 8 and a sensor face 9. The interval may correspond to at most plus or minus 10 degrees, or at most plus or minus 5 degrees, or at most plus or minus 3 degrees. In other words, a limit alpha of the yoke angle may be less than 10 degrees, or less than 5 degrees, or less than 3 degrees.

Even though it is exemplified to use such a pump as described in U.S. Pat. No. 4,991,492 in association with FIG. 1, it is obvious that the present invention is suitable for essentially all hydraulic pumps or motors having a yoke, swash plate or the like feature which is movable in order to change the displacement volume and may be used for sensing the position of the movable part vis-à-vis another static structure.

Figure 2:
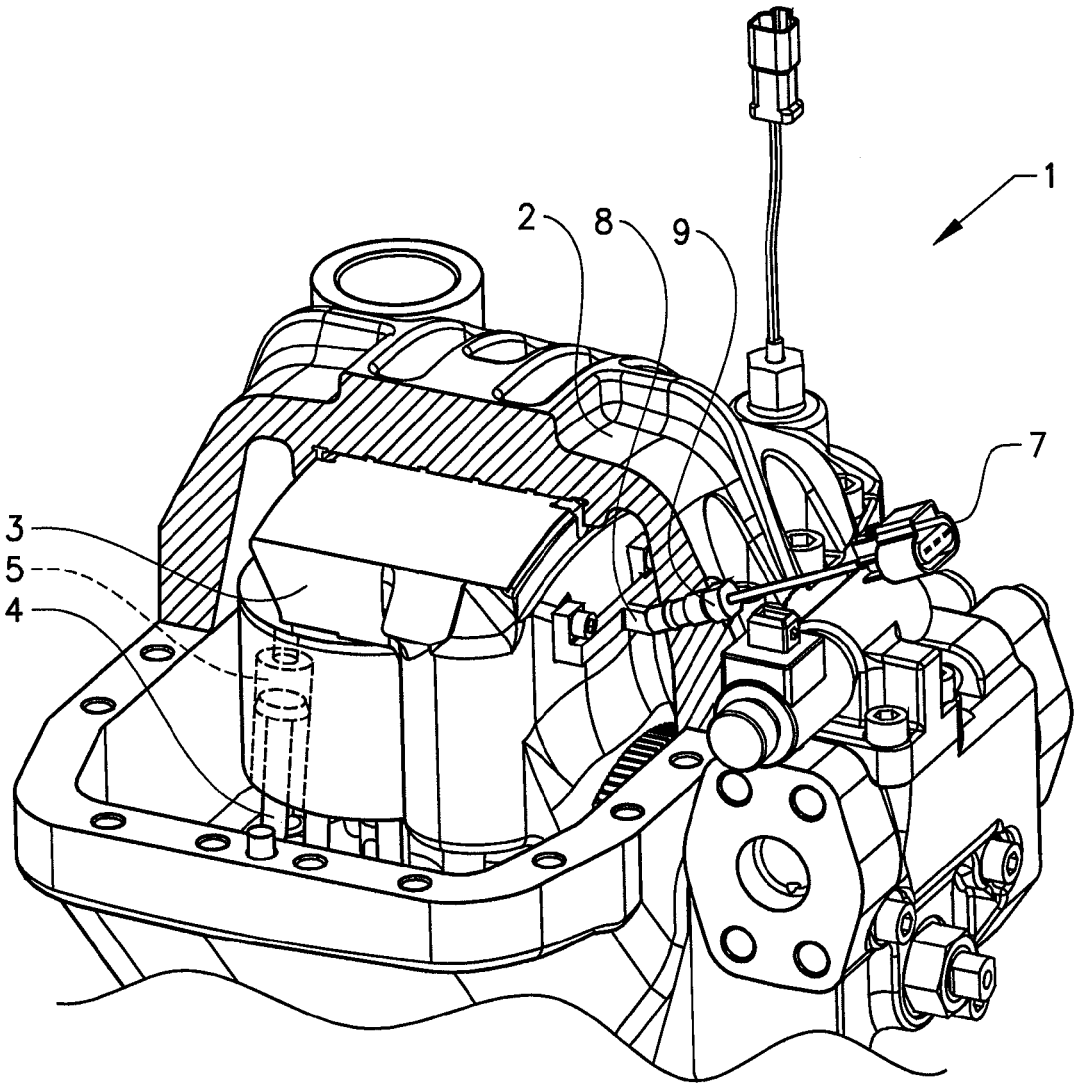
FIG. 2 is a second view of the pump described in FIG. 1.

FIG. 2 shows an isometric view of the hydraulic pump 1 in FIG. 1. A part of the housing 2 has been cut out in the figure such that the relative location of the yoke 3 and the housing 2 may easily be seen. The yoke 3 is located in a zero angle position such that the target bar 8 of the sensor system 7 is facing straight in front of the sensor face 9.

Figure 3:
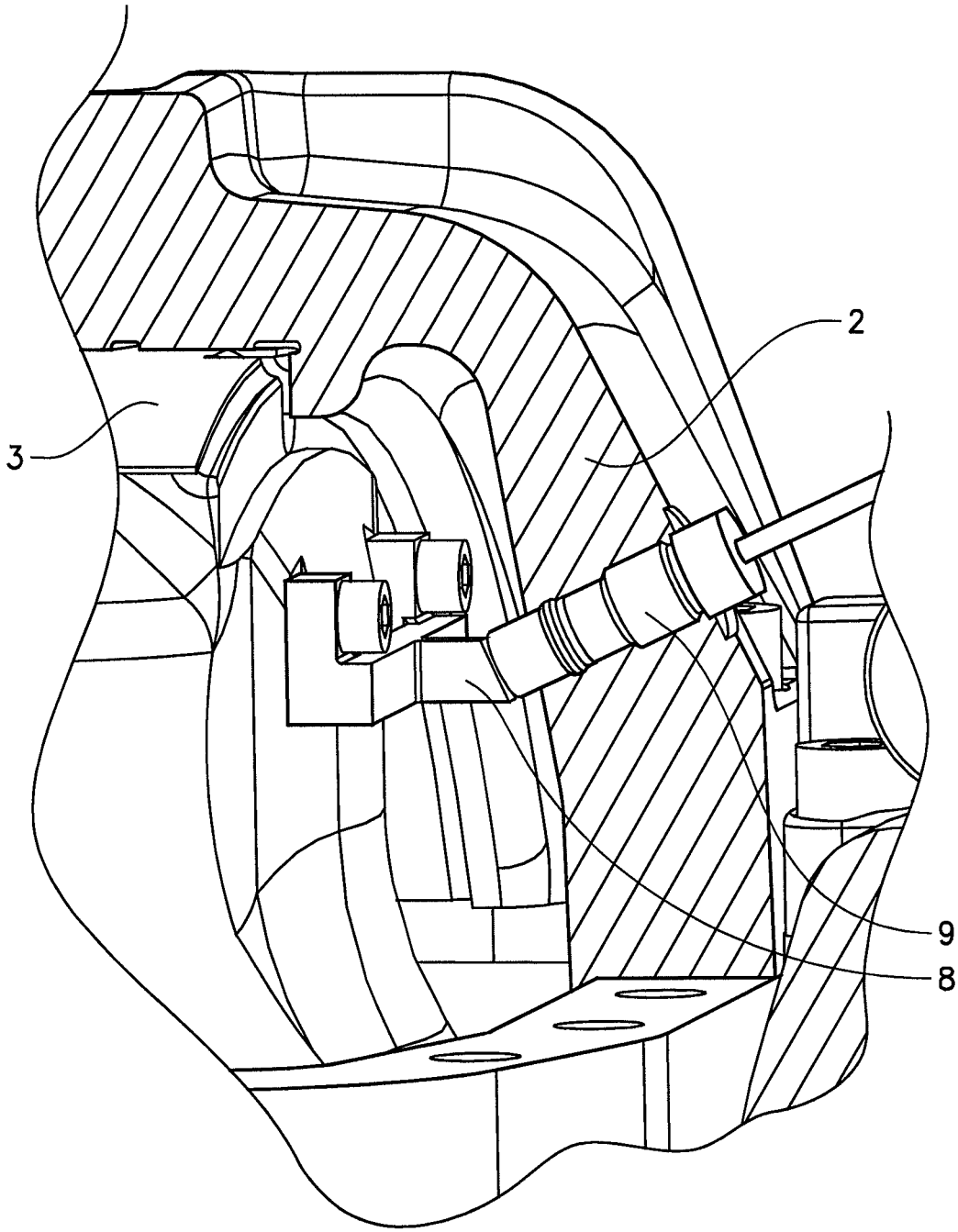
FIG. 3 is a close up view of the MDS described in FIG. 2.

In FIG. 3 is disclosed a close-up of the MDS 7 and the attachment of the indication bar 8 to the yoke 3 and the sensor face 9 to the housing 2.

Figure 4A:
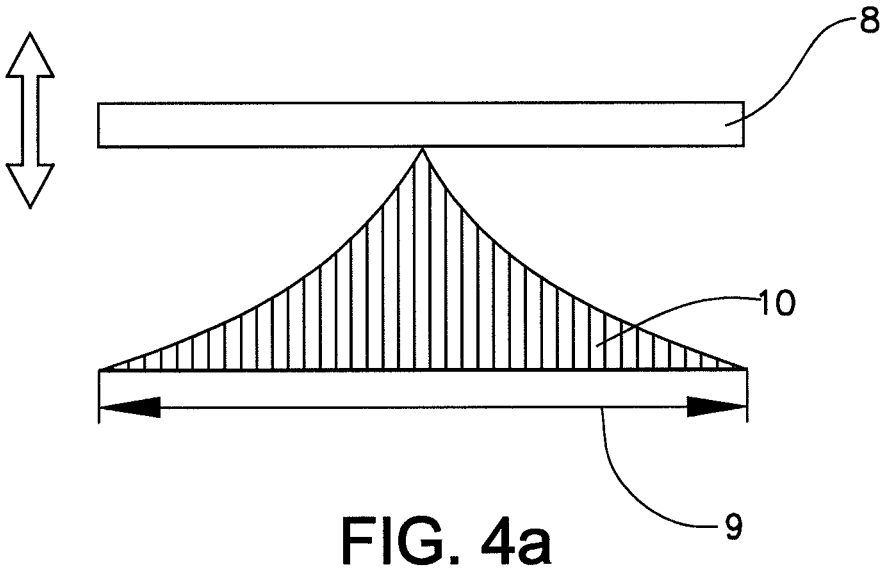
FIG. 4 is a schematic figure of the basic principle for a magnetic MDS.
Figure 4B:
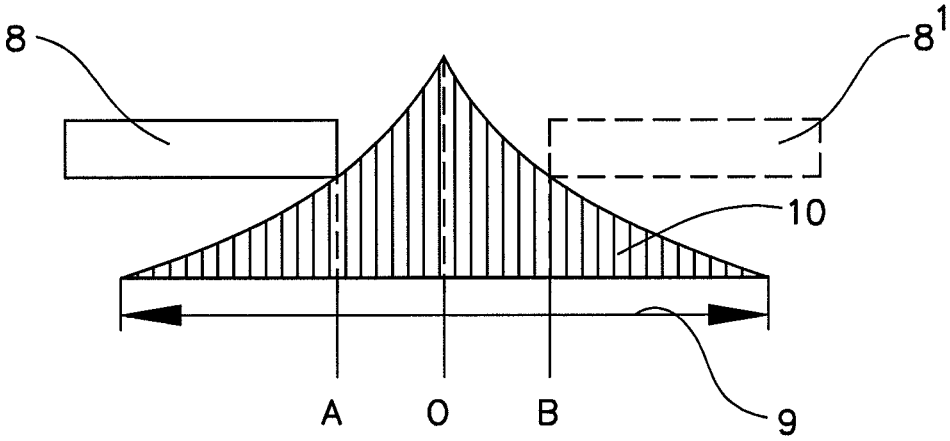

In FIGS. 4*a* and 4*b* is described how an inductive proximity sensor, suitable to be used as the Minimum Displacement Sensor 7 in FIG. 1, works. In FIG. 4*a* is shown a target bar 8 moving in an axial direction, i.e. moving towards and away from the sensor face 9 in a direction perpendicular to the surface of the sensor 9. When the sensor is within a certain range from the sensor face 9, it will be within a target sensing area 10 and presence of the target bar 8 will be indicated. In FIG. 4*a* is shown the position of the target bar 8 at the limit distance where it will enter or leave the target sensing area. Likewise, when the target bar 8 in FIG. 4*b* has moved in the radial direction along the surface of the sensor face 9 and towards sensor face 9, presence of the target bar 8 will be detected when the target bar 8 enters the target sensing area 10. When the target bar 8 has moved further along the sensor face, it will pass the target sensing area and when the target bar 8 has reached the target bar location indicated by dotted lines 8', presence of the target bar 8 is no longer indicated. The sensitivity of the system may be changed by for example change the electromagnetic field strength or the material in the target bar. However, the main feature to be changed for detection of radial movement is the extension length of the target bar 8 in the radial direction along the surface of the sensor face 9. To be noted, this figure only intends to schematically illustrate the principles of how the indication system works and it shall not be interpreted that the actual target sensing area corresponds to the exact shape of the target sensing area 10 illustrated herein.

Figure 5:
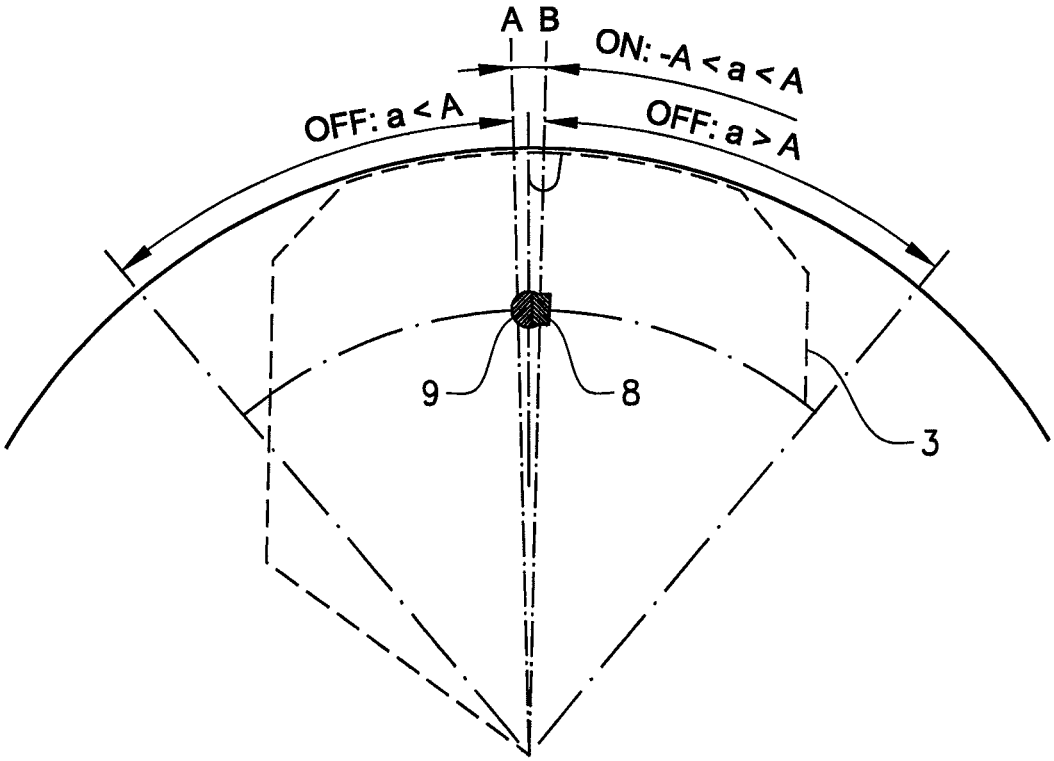
FIG. 5 is a schematic figure of a MDS working range in a variable displacement hydraulic pump having a moveable yoke.

In FIG. 5 is shown a schematic figure of a Minimum Displacement Sensor 7 located in cover 2 of a hydraulic pump 1. An indication bar 8 is located in the yoke 3 (represented by the dotted lines) on the same radial distance from the centre of rotation as the sensor face 9. Furthermore, the sensor face 9 and the indication bar 8 are positioned such that when they are centered in an overlapping position, the position corresponds to the zero angle position of the yoke 3, i.e. the zero displacement position. In this figure, the yoke 3 is slightly turned or rotated such that it has reached the limit zone where the sensor arrangement 7 switches from "ON" to "OFF" at a position B. Hence, the MDS system 7 indicates that the sensor is within the prescribed limits as long as the sensor is present within a distance "a" from the centered, overlapping position of the target bar 8 and the sensor face 9 wherein the distance "a" is from −A to A. For the sake of simplicity, it has been assumed that the MDS system 7 turns on and off at the same distance from the zero angle position.

Figure 6:
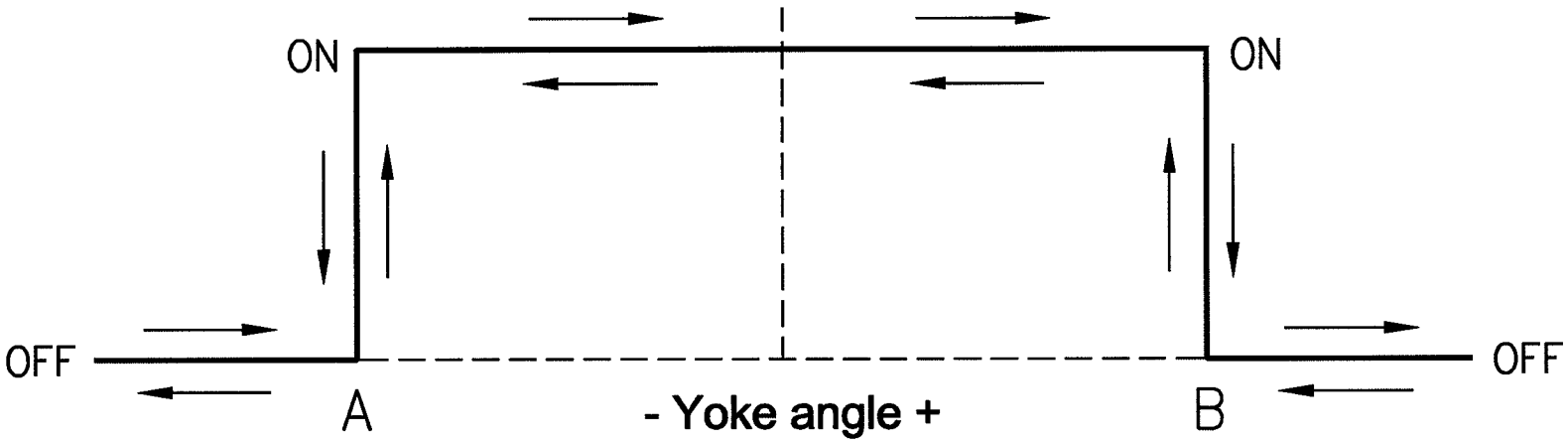
FIG. 6 is a schematic figure showing ideal indication range of a MDS.

This situation, i.e. the switching on and off occurs at the same location, is further described in FIG. 6 where the step function of the sensor being set to on or off is described. By ideal function is meant that there is no hysteresis, no individual variation of sensor performance or no time delay and the sensor is indicating on or off at two sharp points on each side of the zero displacement position. The step function is thus set to "ON" within a prescribed range corresponding to be within a distance "A" from the centered position in FIG. 3. In these figures is indicated a positive value (a distance "B") when the yoke is moved clockwise from its starting (or zero displacement) position and a negative value (a distance "−A") is indicated when the yoke is turned counter-clockwise from the zero yoke angle position.

Figure 7:
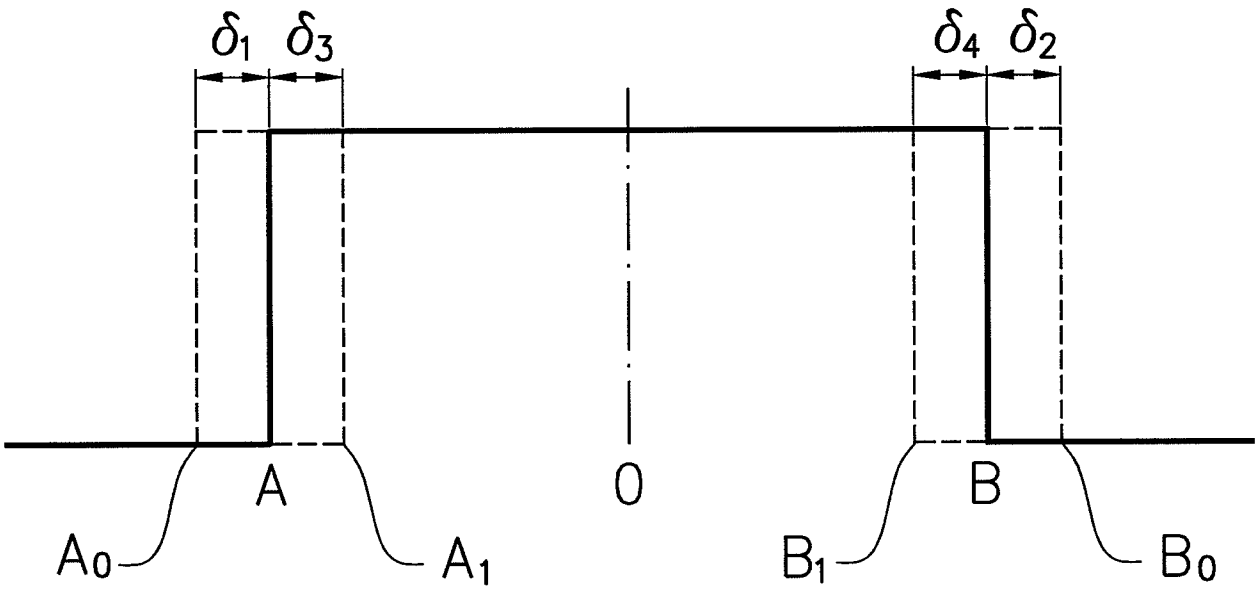
FIG. 7 is a schematic figure showing a MDS indication range taking into account inherent sensor system deficiencies.

In FIG. 7 is described a scenario of having a real life situation where the change over of the sensor signal from "ON" to "OFF" respectively from "OFF" to "ON" vary due to hysteresis or time delay or both. The effect of hysteresis is that the sensor will strive to keep the indicated status which it indicates at a certain position. Hence, the distance or interval in which the sensor will indicate a "ON"-signal, if the signal has been indicating "ON" before, will be broadened to encompass a distance from "A0=A−delta1" to "B0=B+delta2" on each side of the zero angle indication. In general, delta1=delta2=delta and the absolute values |A|=|B| such that the sensor indicating zone encompasses a region having a length extension corresponding to the double value of "|A0|=|B0|=|A|+delta" and extending from the zero yoke position angle a distance |A0| in both directions. Furthermore, the hysteresis will make the zone or interval in which "OFF" is indicated broader, if the yoke has been positioned in an "OFF" position, such that it will only switch over when the yoke reaches a position at a distance "A1=−A+delta3" when approaching the zero yoke angle position from the left and at a distance "B1=B−delta4" when approaching the zero angle position from the right. In general, delta3=delta4=delta and |A|=|B| such that the sensor indicating zone is twice the absolute value of "|A1|=|B1|=|A|−delta" and extends a distance corresponding to |A1| on both sides of the zero yoke position angle when the indication switches from "OFF" to "ON". Hence, the sensor 7 switches on at angles A1 and B1 when the yoke angle is approaching zero and it switches off at angles A0 and B0 when the yoke angle is moving away from zero yoke angle position. The hysteresis makes the absolute values of A0 and B0 larger than the absolute values A1 and B1. This implies that there is a zone on each side of the zero yoke angle wherein the state of the sensor not unambiguously is decided by the position of the sensor but also on its previous position. These areas or intervals of uncertainty may be even broader due to other phenomena such as time delay, which enhances the effect of hysteresis by moving the interval limits towards the zero yoke angle position when the yoke is approaching zero yoke angle and moving the interval limits away from zero when the yoke is moving in a direction away from the zero yoke angle. This uncertainty will increase with increased speed. Furthermore, built-in uncertainty in the sensor arrangement will contribute with white noise in the system and broadening the area of uncertainty in unknown directions.

Hence, the signal from the MDS system 7 and the first Yoke Angle Sensor (YAS) 6 may be used to check the status of the sensor and the system according to the following scheme:

1. MDS status is set to "ON" (small angles) and the YAS is indicating a value within the range from A0 to B0. Hence, both sensors are indicating relevant values and the sensors are considered to be working perfectly well. It is thus considered to be safe to turn on motor operation of the hydraulic pump without risk of undesired, uncontrolled torque acceleration
2. MDS status is set to "ON" (small angles) and the YAS is indicating a value outside the range from A0 to B0. Hence, either of the sensors (YAS or MDS) is out of function and it is not clear in which angle position the yoke is set. Hence, it is not considered to be safe to turn on operation of the hydraulic pump without risk of undesired, uncontrolled torque acceleration and no motor operation is allowed.
3. MDS status is set to "OFF" (large angles) and the YAS is indicating a value outside the range from A1 to B1. Hence, both sensors are indicating possibly relevant values and the sensors are considered to be working perfectly well. In this instance, ongoing motor operation by the pump is allowed to continue while it is not allowed to initiate motor operation due to the too large displacement volume indicated by the sensors MDS and YAS
4. MDS status is set to "OFF" (large angles) and the YAS is indicating a value within the range from A1 to B1. Hence, either of the sensors (YAS or MDS) is out of function and it is not clear in which angle position the yoke is set. Hence, it is not considered to be safe to turn on operation of the hydraulic pump without risk of undesired, uncontrolled torque acceleration and no motor operation is allowed.

As a summary, the second and fourth paragraph above indicates a sensor failure, YAS or MDS, while the first paragraph indicates a safe mode (small yoke angles and thus small displacement volumes) to start motor operation while the third paragraph indicates that continued motor operation is allowed but not initiating a motor operation if not already started.

That which is claimed:

1. A hydraulic device comprising;

a housing;

a yoke which is movably connected to the housing in order to change displacement volume of the device by influencing stroke lengths of pistons in cylinders;

a first yoke angle sensor adapted to sense and indicate a yoke angle so as to provide a control system with a yoke angle indication corresponding to a displacement volume; and a second yoke angle sensor constructed to provide two different output signals wherein the first output signal corresponds to the position of the yoke within a zero displacement angle and the angle being below a value alpha and the second output signal corresponds to an angle between the yoke and the housing being larger than alpha indicating a yoke angle corresponding to a working flow volume.

2. A hydraulic device according claim 1 wherein alpha is no more than 10 degrees.

3. A hydraulic device according to claim 2 wherein the angle alpha is selected to correspond to such small displacement volumes that no acceleration torque is generated.

4. A hydraulic device according claim 2 wherein alpha is no more than 5 degrees.

5. A hydraulic device according claim 2 wherein alpha is no more than 3 degrees.

6. A hydraulic device according to claim 1 wherein said second yoke angle sensor is an electromagnetic sensor.

7. A hydraulic device according to claim 6 wherein said second yoke angle sensor comprises an inductive digital sensor with a fixed position in a cover of the hydraulic device(s), and the yoke comprising a target bar defining the zero displacement angle.

8. A method for detecting the angle of a yoke relative to a housing for a hydraulic device, the yoke being movably connected to the housing in order to change the displacement volume of the device, said yoke comprising cylinders provided with pistons and wherein the zero yoke angle is defined as the angle where the pistons do not move along the axial direction of the cylinders, said method comprising the steps of:

using a first yoke angle sensor adapted to sense and indicate the yoke angle so as to provide a control system with a yoke angle indication corresponding to a displacement volume; and using a second yoke angle sensor constructed to switch between two different output signals wherein the first output signal corresponds to the position of the yoke around a zero displacement angle and the angle being below a value alpha and the second output signal corresponds to an angle between the yoke and the housing being larger than alpha indicating a yoke angle corresponding to a working flow volume.

9. A method according to claim 8 wherein the second yoke angle sensor is configured to sense that said limit alpha of the yoke angle is less than 10 degrees.

10. A method according to claim 8 wherein the second yoke angle sensor is configured to sense that said limit alpha of the yoke angle is less than 5 degrees.

11. A method according to claim 8 wherein the second yoke angle sensor is configured to sense that said limit alpha of the yoke angle is less than 3 degrees.

* * * * *